United States Patent [19]

Katoh et al.

[11] 4,064,598

[45] Dec. 27, 1977

[54] TAKER-IN-PART OF THE CONVENTIONAL FLAT CARD

[75] Inventors: Takashi Katoh, Kariya; Susumu Otani, Aichi, both of Japan

[73] Assignee: Kabushiki Kaisha Toyoda Jidoshokki Seisakusho, Japan

[21] Appl. No.: 652,992

[22] Filed: Jan. 28, 1976

Related U.S. Application Data

[63] Continuation of Ser. No. 580,788, May 27, 1975, abandoned, which is a continuation-in-part of Ser. No. 421,662, Dec. 4, 1973, abandoned, which is a continuation-in-part of Ser. No. 296,214, Oct. 10, 1972, abandoned, which is a continuation of Ser. No. 37,182, May 14, 1970, abandoned.

[30] Foreign Application Priority Data

May 20, 1969 Japan ..... 44-46567
Oct. 22, 1969 Japan ..... 44-100332

[51] Int. Cl.[2] ..... D01G 15/40; D01G 15/82
[52] U.S. Cl. ..... 19/105; 19/107
[58] Field of Search ..... 19/98, 105, 107

[56] References Cited

U.S. PATENT DOCUMENTS

| | | | |
|---|---|---|---|
| 485,680 | 11/1892 | Canning | 19/105 |
| 620,089 | 2/1899 | Threlfall | 19/105 |
| 1,642,758 | 9/1927 | Wilkinson et al. | 19/107 |
| 2,580,582 | 1/1952 | Nix | 19/105 |
| 3,115,683 | 12/1963 | Reitgrer | 19/107 X |
| 3,395,425 | 8/1968 | Vinogradov et al. | 19/105 |
| 3,737,952 | 6/1973 | O'Neal et al. | 19/107 |

FOREIGN PATENT DOCUMENTS

| | | | |
|---|---|---|---|
| 1,421,552 | 11/1965 | France | 19/98 |

OTHER PUBLICATIONS

Gunter Cooke Publication "The G.C. 600M-3 Ace" 10-1968.

*Primary Examiner*—Dorsey Newton
*Attorney, Agent, or Firm*—Burgess, Ryan And Wayne

[57] ABSTRACT

In a high production card, a taker-in undercasing without slits or apertures is disposed beneath a taker-in roller of a card and a suction device is disposed above the taker-in roller. A taker-in cover is mounted atop the taker-in roller and defines therebetween a sealed space in communication with the suction device, which suction device controls the air pressure in said space between the taker-in roller and the taker-in undercasing, so that impurities such as trash are mainly removed from the supplied fibers at a free space below the taker-in roller formed at a position upstream from the taker-in undercasing, and short fibers are separated from successive fibers mainly by the action of the suction device.

6 Claims, 4 Drawing Figures

TAKER-IN-PART OF THE CONVENTIONAL FLAT CARD

This is a continuation of U.S. patent application Ser. No. 580,788, filed May 27, 1975, now abandoned, which was a continuation-in-part of U.S. patent application Ser. No. 421,662, filed Dec. 4, 1973, now abandoned, which was a continuation-in-part of U.S. patent application Ser. No. 296,214, filed Oct. 10, 1972, now abandoned, which was a continuation of U.S. patent application Ser. No. 37,182, filed May 14, 1970, now abandoned.

BRIEF SUMMARY OF THE INVENTION

The present invention relates to an improvement of a taker-in part of a conventional flat card, more particularly to an apparatus for controlling accompanying air streams created outside the surface of taker-in roller which is rotating at very high speed, so that the separation of impurities and short fibers from useful fibers can be successfully carried out in a uniform condition.

It is well-known that one of the outstanding features of the conventional high speed card is that the working efficiency of removing impurities such as trash at a position below the taker-in roller is very high, but still is lower than that of the present invention. In the conventional high speed card, the taker-in roller is driven at high speed so as to treat an increased quantity of supplied fibers. And the fiber tufts are carried by an accompanying air stream created outside the surface of the taker-in roller by the rotation of the taker-in roller, while the impurities such as trash are separated from the above-mentioned accompanying air stream and then they fly tangentially from the surface of the taker-in roller, because the centrifugal force imparted to the impurities is distinctly larger than that imparted to the fibers. Consequently, due to the difference of said forces, the separation of such impurities from the useful fibers can be easily carried out by the conventional high speed card, however, more easily carried out by the present invention. Accordingly, the above-mentioned function of the taker-in roller can be strengthened by increasing its rotation speed. However, even though a large quantity of impurities can be removed from the supplied fibers, by said impurities removing device, said device had such drawbacks as separating some fibers from the fibers at the free space below the taker-in roller, or the variation of the impurity removing function of the card at the position of the taker-in roller. When these drawback conditions occur the quality of slivers produced by the high speed card are changed.

In other words, in the high-speed card, in which the fiber tufts are carried by the accompanying air stream created outside the surface of the taker-in roller, the function of said air stream in the free space below the taker-in roller must be always maintained in such a condition that said impurities can be separated from the useful fibers and also the fiber tufts can be carried by said air stream toward a cylinder.

When a mote knife is arranged in the region of said free space beneath the taker-in roller, for the purpose of removing impurities and short fibers, the higher the speed of the roller is, the larger the disturbance the smooth flow of the accompanying air stream. More importantly, the transportation of the fiber tufts toward the cylinder becomes difficult, and at times, nearly impossible.

Similar adverse results occur when a conventional undercasing, which is provided with a plurality of small holes and a plurality of opening-like slits, is arranged downstream from said region of the free space and beneath said taker-in roller. In this case, if the amount of the accompanying air stream is increased, the amount of air flows passing through said slits and holes is correspondingly is increased to such an extent that it more than that of a conventional low speed card. Occasionally, both ends of a long-length, useful fiber are drawn into two of the holes, thus forming a kind of bridge. When this happens, a tuft of useful fibers accumulates in the under-casing. This condition is worsened when said tuft grows larger, as the card continues running. Before long, the tuft will completely cover all of the holes and slits, whereby said holes and slits will cease functioning. This means that higher pressure is generated between the taker-in roller and the under-casing because of the tufts accumulated on the inner surface of the under-casing, which in turn causes the smooth accompanying air stream flowing from the free space to the space between the taker-in roller and the undercasing, to be stopped. Because of this, the conveyance of the fiber tuft along the inner surface of the under-casing can not be carried out properly, therefore, most of such fiber tufts can be removed in the region of the free space and are dropped below the taker-in roller before they enter said undercasing. When the large mass of fiber tufts resting on the inner surface of the under-casing reaches the surface of the cylinder after moving along the inner surface of the under-casing together with useful fibers, such movement of the fiber tufts results in the appearance of a lateral streak pattern in the web delivered from the doffer of said card.

As mentioned above, when using a conventional undercasing arrangement disposed beneath the high speed taker-in roller, it is impossible to produce a uniform sliver because the impurities cannot be successfully separated from the useful fibers by said accompanying air stream.

The object of the present invention is to provide a card with a high speed taker-in roller, by which effective removal at the underside of said taker-in roller of impurities and short fibers from the useful fibers can be accomplished, and by which a sliver of good quality can be produced.

In order to realize this object, air pressure in the space disposed between the taker-in roller and the under casing, according to the present invention, is constantly controlled so that its pressure can be maintained at the necessary level. In the present device, the accompanying air stream is created outside the surface of the taker-in roller, especially within the free space disposed between the dish plate and the taker-in under-casing. Because of this, impurities which are moving at a large centrifugal acceleration fly out of said air stream tangentially from the surface of the taker-in roller, while the useful fibers are conveyed by said air stream toward the cylinder. And further more, a good removal of the short fibers from the upper region of the taker-in roller can be realized. Thus effective removal of the impurities and short fibers in the high speed card of the present invention can be realized.

This embodiment of the present invention, consists of a large enclosed space disposed above the taker-in roller which has low air pressure therein, a suction apparatus disposed in said enclosed space, and a taker-in undercasing having a smooth and uninterrupted, curved surface with no holes or slits. By this embodiment the desired level of air pressure in the space between the taker-in roller and the under-casing and also in the region near the inlet of said space can be controlled by a suction force of said suction apparatus, so that a desired accompanying air stream can be created. Thus, an accompanying air stream can be continuously created beneath the taker-in roller, and the removal of the impurities is optimum. Also, the short fibers can continuously be separated from the useful fibers when they pass through the facing point between the cylinder and the taker-in roller and then can be successfully removed by the suction force.

BRIEF DESCRIPTION OF THE DRAWINGS

Referring to FIG. 1 showing one embodiment of the present invention, an improved taker-in part comprises a taker-in under-casing and controllable suction means for positively controlling the air pressure around the taker-in roller. The taker-in under-casing 1 comprises an inside plate 1*a* facing a taker-in roller 3 and an outside plate 1*b* connected at both ends with the inside plate 1*a*. The cylinder-side edge of the inside plate 1*a* is connected to an under-casing 4*a* of a main cylinder 4. The inside plate 1*a* is a smooth and solid curved plate free of any apertures or slits therein so that normal fibers delivered from a nip point between a feed roller 5 and a dish plate 2 can be carried through the free space between the dish plate 2 and the taker-in under-casing, by the accompanying air stream created outside the surface of the taker-in roller 3, and then smoothly carried to the main cylinder 4 by saw teeth of the taker-in roller 3 together with an air stream flowing in a space 1*c* between the taker-in under-casing 1 and the taker-in roller 3, while short fibers or impurities such as dust are dropped downward into an opened space under the taker-in roller 3.

When the running speed of the taker-in roller is increased to as high as 600 – 1200 r.p.m. from the conventional running speed of about 400 r.p.m., in order to increase the production rate for card, the amount of and also the speed of the accompanying air stream created outside the surface of the taker-in roller are considerably increased. This means that the centrifugal force being imparted to the fibers which are being conveyed by said accompanying air stream becomes very strong. It also means that impurities such as trash or leaves are separated from the accompanying air stream by said centrifugal force which causes them to fly out of said air stream tangentially from the surface of the taker-in roller.

Table I

| Classification of the size of impurity | Measured Final Speed Ut Value Obtained by a Free Dropping Test | | | | |
|---|---|---|---|---|---|
| | A | B | C | D | D.D |
| Mean diameter in mm | 0.5 ~1.0 | 1.0 ~1.5 | 1.5 ~2.0 | 2.0 ~2.5 | 2.5< |
| Leaf impurity in cm/sec. | 50 ~80 | 55 ~70 | 55 ~130 | 35 ~130 | 25 ~100 |
| Seed impurity in cm/sec. | 10 ~20 | 15 ~110 | 35 ~110 | 35 ~140 | 60 ~125 |
| Fiber in cm/sec. | fiber tufts consist of some fibers single fibers | | | | 5~20 4~10 |

Figure 1:
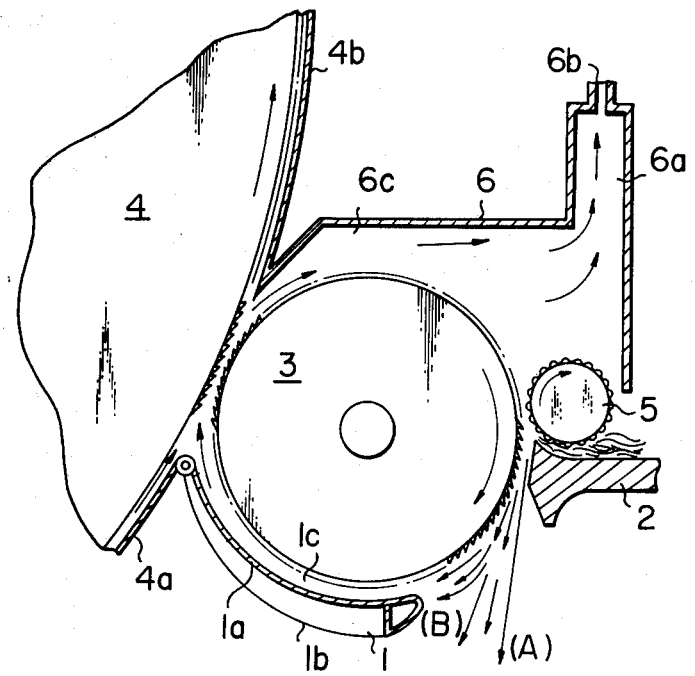
FIG. 1 is a schematic side view, partly in section, of an embodiment of a taker-in roller part constructed according to the present invention.

As can be seen from the above table, the final dropping speed of the impurity is higher than that of the useful fiber of short fiber. Such impurities can be separated from the fiber after flying out of the free space and travelling along the flying passage (A) as shown in FIG. 1. On the other hand, the useful fiber or short fiber having a small final dropping speed Ut can be conveyed toward the space between the taker-in roller and the under-casing, by the movement of the accompanying air stream created outside the surface of the taker-in roller. Such separation of the impurities from the useful fibers is related to and influenced by the level of the accompanying air flow created within the free space. When considering yield rate of fibers on the card, said rate will become low because the creation of such high air pressure tends to decrease the undesirable influence upon the removal of the impurities caused by the effect of the centrifugal acceleration created by the accompanying air stream flowing into the region between the taker-in roller and the under-casing. However, even if good separation of impurities can be realized, drawbacks still occur. For example, turbulance of the accompanying air stream flowing into the region between the under-casing and the taker-in roller occurs. This turbulant flow of air can create a drawback, i.e. that useful fibers normally conveyed toward said region are separated from the air stream at the region of the free space.

When the air pressure in the space between the taker-in roller and the under-casing is lowered considerably, the amount of the accompanying air stream entering said region should be increased so that said stream can covey the fibers satisfactorily. Unbalanced centrifugal acceleration then acts on the impurities. In this way, the impurities removed from the air stream are also conveyed into said region. Once such conveyance of impurities occurs, the separation of the impurities from said air stream becomes poor, and the quality of the sliver produced by this card deteriorates.

Consequently, when air pressure in the space between the taker-in roller and the under-casing is increased to a given level, and completely controlled so that said level can always be maintained, a desirable accompanying air stream can be created within the region of the free space. This means that superior separation of the impurities from the useful fibers on the high speed card can be realized.

To effect such a creation of the air stream, and also to remove short fibers from the surface of the taker-in roller, the arrangement of the present invention uses a combination of an under-casing provided with no holes or slits and having a smooth and solid curved plate, and a cover together with a taker-in roller which defines a large space disposed above the taker-in roller. Said space is connected to a suction means.

To effectuate the above-mentioned controlling of the air pressure, a positive suction means for controlling the air pressure about the taker-in roller 3 is further utilized for the present embodiment. That is, a sealed space 6c is provided above the taker-in roller 3 and this space 6c is connected to a suction duct so that air above the taker-in roller 3 is sucked into the suction duct. To provide the above-mentioned sealed space, a taker-in cover 6 is mounted above the taker-in roller 3 in such a way, that the cover 6 is connected to a main cylinder cover 4b and a bottom end of the cover faces the feed roller 5, and the space defined by the taker-in cover 6 and the taker-in roller 3 is sufficiently large to decrease the air pressure in the space 1c. As noted in FIG. 1, the distance between the cover and the taker-in roll is substantially greater than the distance between the under-casing and the taker-in roll except in the region most closely adjacent the main cylinder. The taker-in cover 6 is provided with an aperture 6b which is connected to a suction duct (not shown). Therefore, air delivered from the space 1c to a facing portion of the main cylinder 4 with the taker-in roller 3 can be led into the space 6c and sucked into the suction duct through a guide space 6a and the aperture 6b of the taker-in cover 6. Consequently, by adjusting the suction condition of the suction duct, the air pressure about the taker-in roller 3, particularly air pressures in the space under the taker-in roller 3 and the space 6c can be effectively controlled. In other words, the air pressure in the space 1c can be controlled at a low condition so that dropping of excess fibers to the free space under the taker-in roller can be prevented and short fibers carried to the main cylinder 4 by the air stream and saw teeth of the taker-in roller 3 are sucked into the space 6c above the taker-in roller 3 and finally discharged from the taker-in part of the card.

As mentioned, above, the relation between the air pressure in the space between the taker-in roller and the under-casing, and the air pressure in the space 6c defined by the cover and the upper side of the taker-in roller can be influenced by the generation of the accompanying air stream within the region of the free space. When the rotation of the taker-in roller of 200 mm diameter is 1150 r.p.m., a mean volume of 2 - 3 $m^3$/min of air can be generated by the fan action of said high speed taker-in roller. Consequently at least 3 $m^3$/min of air must be sucked into the suction duct (not shown) communicated to the suction hole 6b and discharged to outside.

When a taker-in cover 6 is closely arranged to the taker-in roller, which is similar to the arrangement of a conventional card, with a narrow space between said cover and said taker-in roller, the decreasing pressure curve in both spaces is not desirable. When the amount of the air flow is increased as mentioned above, the air pressure at the region of the inlet and also between the taker-in roller and the under-casing, is not able to reach such high level as expected, a level as high as that of the present invention. In the present invention, by providing space 6c above the taker-in roller 3, the decreasing pressure curve is made optimum, and also the air pressure in the space between the taker-in roller and the under-casing is as high as the level mentioned above. Tests show that, in this case said space 6c must be wide so that the static air pressure is as low as 5 mm WG. When said suction force is newly applied to said space 6c, the static air pressure within said space 6c drops as low as $-2\sim -5$ mm WG. As a result of this, the static air pressure of $-1\sim -8$ mm WG., which is necessary to produce a good accompanying air stream, can be created within the space between the taker-in roller and the under-casing.

Figure 2:
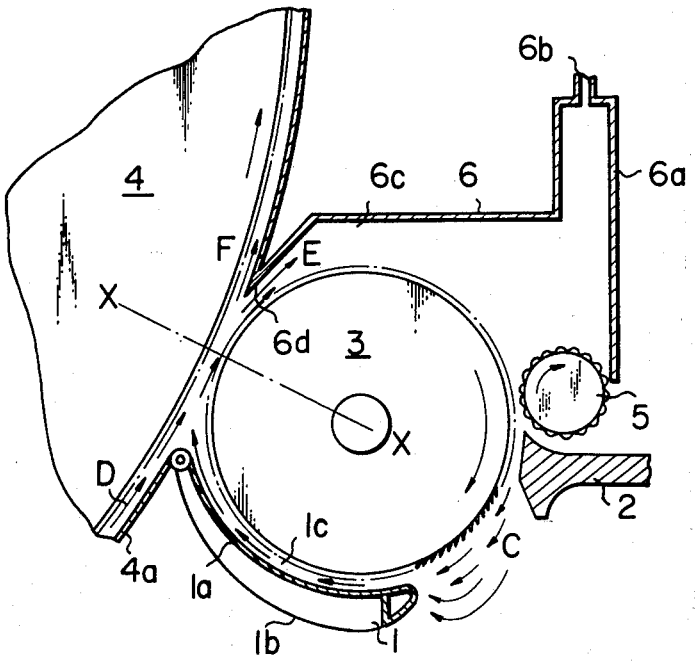
FIG. 2 is an explanatory side view of the embodiment of a taker-in roller part shown in FIG. 1.
Figure 3:
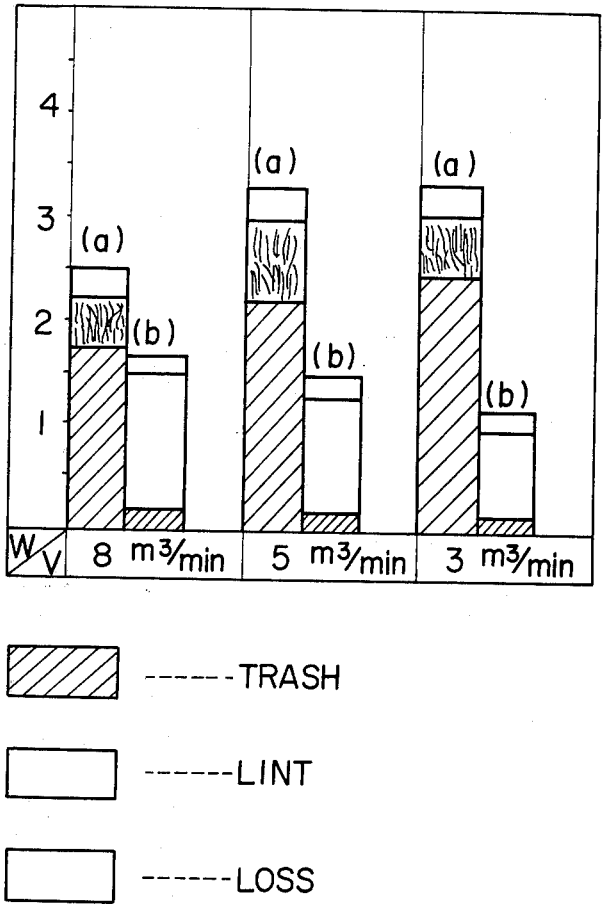
FIG. 3 is an explanatory diagram indicating the relation between the contents of waste under the taker-in roller and the suction force created above said taker-in roller.

Furthermore, as mentioned above, the useful fibers already separated from the impurities at the region of the free space below the taker-in roller, can be conveyed into the space between the taker-in roller 3 and the under-casing 1 together with the short fibers, as is the case using a conventional card, by the rotation of the taker-in roller 3. Finally, they enter the facing portion between the cylinder 4 and the taker-in roller 3. As shown in FIG. 2, at the facing point X — X between the cylinder 4 and the taker-in roller 3 the accompanying air stream C of the taker-in roller 3 and the accompanying air stream D of the cylinder 4 are combined into one air stream, where said combined air stream can be extremely compressed. After passing said facing point X—X, said combined air stream is converted into a jet air stream E flowing toward the space 6c from the facing point between the cylinder 4 and the cover 4b, due to the provision of the space 6c, which is under minus pressure due to the suction means connected thereto. Consequently, the useful fibers conveyed by the taker-in roller 3 are transported on the surface of the cylinder 4 at the facing point therebetween, and are conveyed in the direction F toward top flats, by the rotation of the cylinder 4. Said useful fibers can be carded by the carding action generated by the combination of the top flats and the cylinder 4. In this case, the short floating fiber which are not being held by the carding wires on the cylinder 4, are carried toward the space 6c by the conveying effect of said jet air stream E. Thus, the separation of useful long fibers from the short fibers can be carried out effectively. The short fibers carried into the space 6c move at a very slow speed within said space 6c, which causes them to float in the air. They can then be removed from said space by the suction means. According to the present invention, the removal of the impurities can be realized at the region beneath the taker-in roller, while the removed of the short fibers can be effected at the upper region of said taker-in roller. This means that each removal can be carried out effectively, as can be understood from FIG. 3. FIG. 3 indicates the relation between the contents of waste beneath the taker-in roller and the suction force created above the taker-in roller, wherein, *a* indicates the drop waste underneath said taker-in roller, *b* shows the content of waste sucked out from the upper region of the taker-in roller; V is the amount of suction air at the upper region of said taker-in roller, and W is a percentage between the amount of removed waste and the amount of the infed stock of fiber. Another characteristic of the present invention is that there is no removal of the short fibers by passing through an aperture or slit, since the undercasing has no apertures or slits. After being conveyed through the space 1c, the short fibers can be separated from the surface of the taker-in roller, and discharged into the space 6c in their floating condition on the air flow of reduced pressure within said space 6c. Then, the short fibers can be removed from the space 6c by the suction means. Due to this conveying of the short fibers along the surface of the taker-in roller, and due to the removal of the short fibers from the surface of the taker-in roller, there is no chance of any drawbacks occurring such as accumulation of the short fibers on apertures or slits, as in the case of the conventional undercasing. Therefore, by the apparatus of the present invention, the removed short fibers can be maintained in a constant amount during the carding operation and, thus, a good sliver with even quality can always be produced by the carding machine.

A further feature in accordance with the invention, as is apparent from FIGS. 1 and 2, the taker-in undercasing is adjusted so that its forward or front edge is closer to the taker-in roll than the rear edge thereof. This relationship further reduces any currents, and minimizes the amount of trash that enters into space between the taker-in undercasing and the taker-in roller. FIG. 2, elements having the same functions as those of elements of FIG. 1 are represented by the same numerals, respectively.

Figure 4:
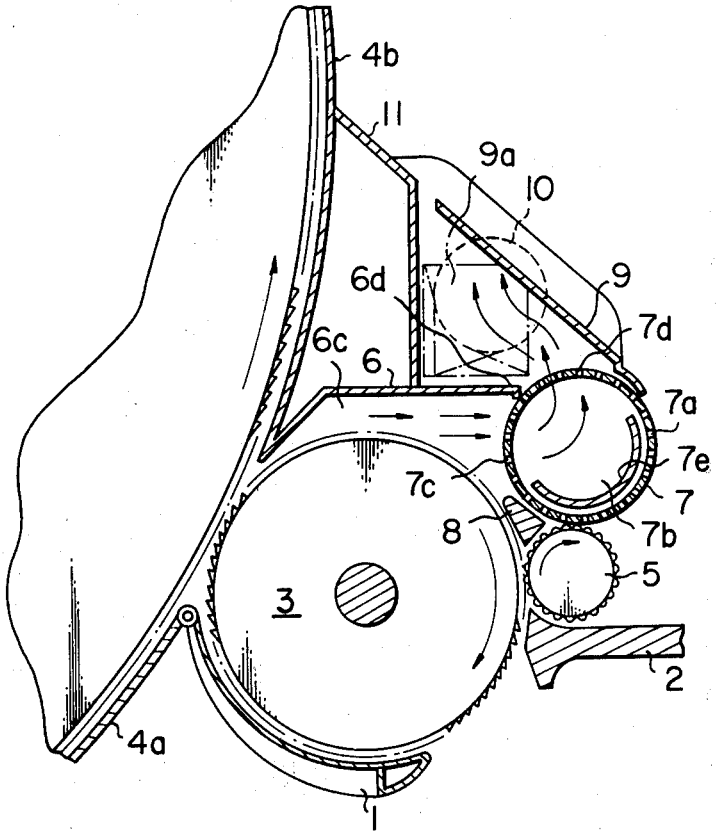
FIG. 4 is a schematic side view, partly in section of another embodiment of a taker-in roller part constructed according to the present invention.
Figure 3:
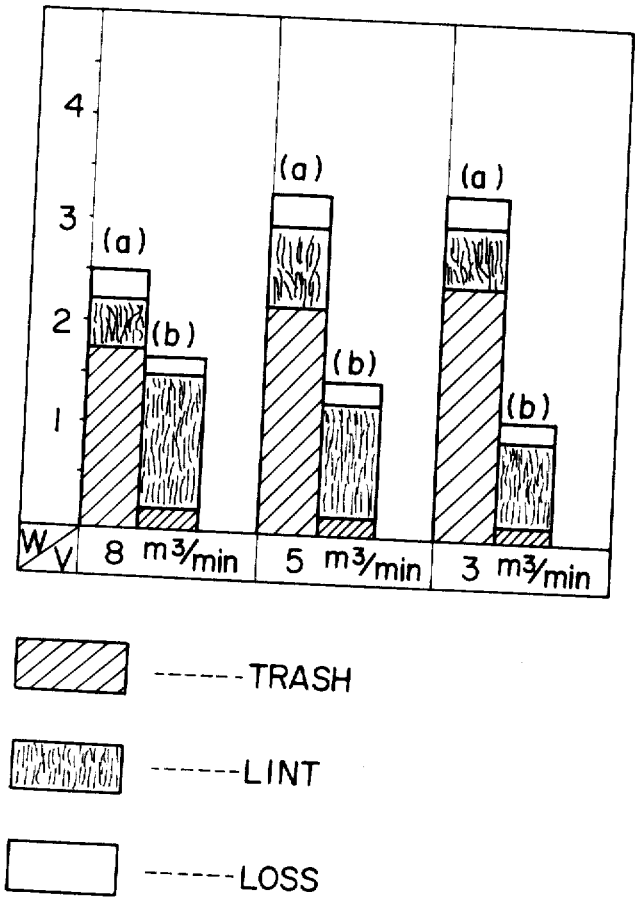

In the second embodiment shown in FIG. 4 suction means connected to the taker-in cover 6 is further modified with respect to the first embodiment shown in FIG. 1. That is, instead of employing the guide space 6*a* and forming the bottom edge adjacently facing the feed roller 5, a cage roller 7 is disposed between the free edge 6*d* of the taker-in cover 6 and the feed roller 5 without gaps, as shown in the drawing. Said cage roller 7 is provided with numerous apertures 7*a* so that air can pass freely therethrough. A suction guide duct 9*a* is formed above the taker-in cover 6 and the cage roller 7 by a wall plate 11, which is connected to the taker-in cover 6 and the cylinder cover 4*b*, and by an upper plate 9 disposed above the cage roller 7 in such a way that a bottom edge of the upper plate 9 adjacently faces the cage roller 7. The guide duct 9 is connected to a suction duct 10, thereby air is discharged from the guide duct 9*a*. The cage roller 7 contacts the feed roller 5 and is driven at the same circumferential speed as that of said feed roller 5. A stationary air damper 7*e* is disposed inside the cage roller 7 in such a way that, when the apertures 7*a* come to the free openside of the cage, the opening of the apertures 7*a* are closed from inside the cage roller 7. A knife plate 8 is adjacently disposed above the taker-in roller 3 at a position surrounded by the cage roller 7, feed roller 5 and the taker-in roller 3 respectively, so that short fibers in a floating condition carried by the saw teeth of the taker-in roller are removed from the saw teeth and are carried to the cage roller 7.

As already described in the illustration of the first embodiment, the air stream, due to suction into the discharge duct 10, includes short fibers therein. Said short fibers are led into a space 7*b* together with air through the apertures 7*a*, and then discharged therethrough into the guide duct 9*a* together with air. Since the cage roller 7 rotates, even if these short fibers are caught by the adjacent apertures 7*a*, these short fibers can be easily removed from the apertures 7*a* by the alternative actions of suction or ejection of air through these apertures 7*a* which occurs alternately at positions 7*c* or 7*d*, respectively. Therefore, clogging of these apertures 7*a* can be completely prevented. As a result of experimental test, we have found that spinnable normal fibers are sometimes included in the air stream coming into the space 6*c* above the taker-in roller 3. However, these fibers are caught by the cage roller 7 and carried to the nip point of said cage roller 7 and the feed roller 5 so that these fibers are again fed to the taker-in roller 3 together with fiber tufts fed from the dish plate 2 and the feed roller 5. As mentioned above, the second modified embodiment of the present invention has characteristic features in addition to those of the first embodiment.

What we claim is:

1. In the method for effectively removing impurities such as trash particles and short fibers from useful cotton fibers wherein a conventional flat card is provided with a main cylinder and a revolving flats turnably mounted on an upper cylindrical portion of said cylinder, the method comprising rotating a taker-in roller disposed at a position adjacent to said main cylinder, and feeding fibers to said taker-in roller; the improvement comprising providing a smooth unapertured taker-in undercasing at a position adjacent the underside of said taker-in rollers that a free space is formed below said taker-in roller between the position at which fibers are fed to the taker-in roller and the front edge of said taker-in undercasing, the rear edge of said taker-in undercasing extending adjacent the position where said taker-in roller most closely approaches said main cylinder, and providing a taker-in cover at a position above said taker-in roller, with the distance between said cover and said taker-in roller being substantially greater than the distance between said undercasing and said taker-in roller except in the region most closely adjacent said main cylinder, said method further comprising rotating said taker-in roller at a speed of at least 600 rpm, whereby an accompanying air stream is created at a position outside of cylindrical surface of said taker-in roller by said rotation of said taker-in roller, and the centrifugal force of said trash particles is sufficiently strong to mainly separate them from said accompanying air stream at said free space below said taker-in roller, said accompanying air stream thereby carrying primarily useful fibers and short fibers through the space between said taker-in roller and said taker-in undercasing, forming a combined airstream by said accompanying air stream of said taker-in roller with an accompanying air stream formed around said main cylinder so that said useful fibers are mainly transmitted from said accompanying air stream of said taker-in roller to said main cylinder, creating an offset air stream from said combined air stream at a position adjacent and above said position at which said taker-in roller most closely approaches said main cylinder by sucking air from between said cover and taker-in roller so that said short fibers contained in said accompanying air stream of said taker-in roller are mainly introduced into the space above said taker-in roller and consequently said short fibers are separated from said useful fibers transmitted to said main cylinder, said step of suctioning air comprising sucking air from the space above said taker-in roller so that creation of strong eddy current at a position adjacent and above said feeding position is prevented, whereby said introduced short fibers are effectively discharged from said space above said taker-in roller by said step of sucking air and further comprising the step of setting the front edge of said taker-in undercasing to be close to said taker-in roll than the rear edge thereof, whereby eddy currents are reduced and the quantity of trash particles passing in the space between said taker-in roller and taker-in undercasing is minimized.

2. The method of claim 1 wherein said step of sucking air comprises removing air from the space between said cover and said taker-in roller at a rate at least equal to the rate at which said accompanying air stream is created by the rotation of said taker-in roll.

3. The method of claim 1 wherein said step of suctioning air comprises removing air from said space above said taker-in roller at a rate at least equal to the rate at which air is introduced into the space between the taker-in roller and taker-in undercasing by the rotation of said taker-in roller.

4. The method of claim 1 wherein said step of suctioning air comprises sucking air from the space above said taker-in roller to maintain the pressure between said taker-in roller and said taker-in undercasing in a range of −1 to −8 mm WG.

5. The method of claim 1 wherein said step of suctioning air comprises sucking air to maintain the pressure in the space between said taker-in roller and cover in the range of −2 to −5 mm WG.

6. The method of claim 1 further comprising maintaining the air pressure above said taker-in roller at a substantially constant level over substantially the entire upper surface of said taker-in roller.

* * * * *

UNITED STATES PATENT OFFICE
CERTIFICATE OF CORRECTION

Patent No. 4,064,598 Dated December 27, 1977

Inventor(s) Takashi Katoh, et al

It is certified that error appears in the above-identified patent and that said Letters Patent are hereby corrected as shown below:

Figure 3 should be deleted to insert the attached Fig. 3 therefor.

Column 1, line 47: "had" should be --has--.

Column 2, line 8: "is" should be deleted.

line 24: "can not" should be --cannot--.

line 59: "further more" should be --furthermore--.

Column 4, line 16: "of" should be --or--.

line 36: "turbulance" should be --turbulence--.

lines 38-39: "turbulant" should be --turbulent--.

line 46: "covey" should be --convey--.

Column 5, lines 15 and 17: "roll" should be --roller--.

Column 6, line 29: "fiber" should be --fibers-- line 40: "removed" should be --removal--.

Column 7, line 7: "roll" should be --roller--.

line 10: Before "Fig. 2" insert --In--.

UNITED STATES PATENT OFFICE

CERTIFICATE OF CORRECTION

Patent No. 4,064,598 Dated December 27, 1977

Inventor(s) Takashi Katoh, et al

It is certified that error appears in the above-identified patent and that said Letters Patent are hereby corrected as shown below:

Column 7, line 30: "10, thereby" should be --10. --; "air" should be --Air--.

Column 8, line 4: "a revolving flats" should be --a revolving flat--.

line 11: "rollers that " should be --roller so that--.

line 55: "roll" should be --roller--.

line 64: "roll" should be --roller--.

Signed and Sealed this

*First* Day of *May 1979*

[SEAL]

*Attest:*

RUTH C. MASON
*Attesting Officer*

DONALD W. BANNER
*Commissioner of Patents and Trademarks*